United States Patent [19]

Watson

[11] Patent Number: 5,007,877

[45] Date of Patent: Apr. 16, 1991

[54] NOVELTY MAGNETIC TOP

[76] Inventor: Thomas A. Watson, 2358 Workman St., Montreal, Quebec, Canada, H3J 1L6

[21] Appl. No.: 468,131

[22] Filed: Jan. 16, 1990

[51] Int. Cl.[5] ..... A63H 1/02

[52] U.S. Cl. ..... 446/242; 446/258; 446/259

[58] Field of Search ..... 446/256, 258, 259, 484, 446/242, 257

[56] References Cited

U.S. PATENT DOCUMENTS

| | | | |
|---|---|---|---|
| 3,591,181 | 7/1971 | Stewart | 446/259 X |
| 3,783,550 | 1/1974 | Andrews | 446/484 |
| 4,200,283 | 4/1980 | Andrews et al. | 446/259 X |

*Primary Examiner*—Mickey Yu

[57] ABSTRACT

A permanent magnetic top is arranged to rotate on one or more surfaces, of a toy induction turret, which are in close proximity to a coil. An electric circuit is arranged to switch the coil in such a manner so as to accelerate the top. A handle is connected to the turret so that the top may be skillfully transferred from one surface to another. In one version it is arranged to generate a tone or musical notes when the top is spinning.

9 Claims, 1 Drawing Sheet

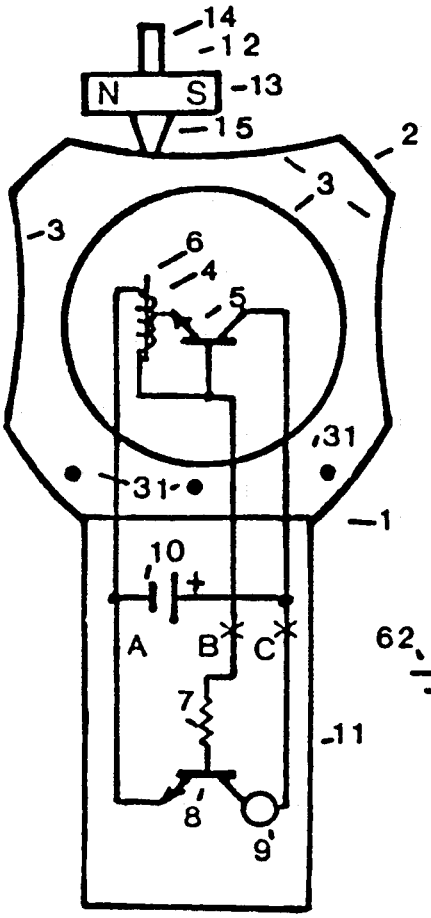
FIG 1
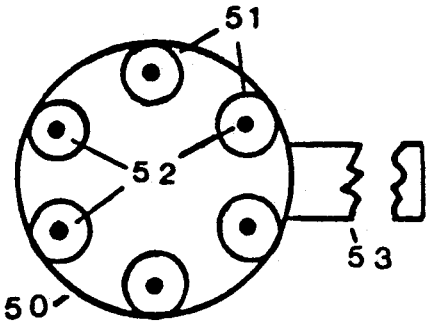
FIG 4
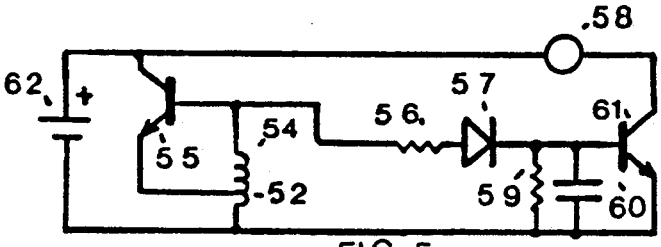
FIG 5
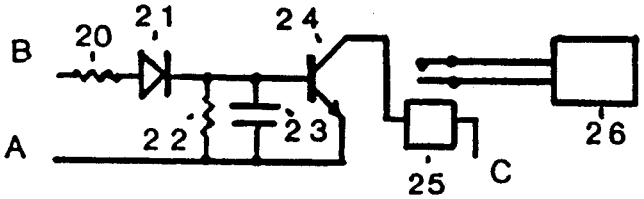
FIG 2
FIG 3
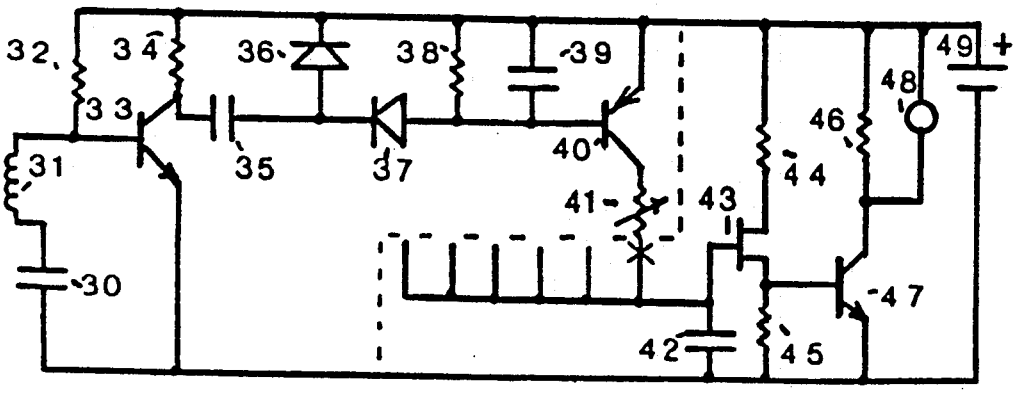

NOVELTY MAGNETIC TOP

This invention relates to a magnetic toy and more particularly to an electric motor having a magnetic top as a rotor, in which the top can be manipulated in a skillful fashion. Andrews, U.S. Pat. No. 3,783,550 describes a novelty electric motor comprising a magnetic top and an induction coil which is automatically energized from a battery. The spinning of the top on a concave surface close to the coil, induces voltages in the coil which cyclically turns on a transistor. The transistor when switched on connects the battery to the coil producing a magnetic field which accelerates the top. The top spins on a concave surface in close proximity to the coil.

By attaching a handle to the combination of the coil, battery, transistor and concave surface a turret is formed, on which the top can be skillfully manipulated. Also by placing several concave surfaces in close proximity to the coil, the top maybe thrown from one surface to another, wherein it is accelerated on each surface, thereby keeping it spinning.

Two induction turrets can be used to juggle two or more tops. A sounder is used to produce a buzzing note or a musical note when the top spins on a concave surface. In one arrangement it acts as a musical instrument by producing a different note for each surface the top spins on.

An objective of the invention is to provide a hand held device, having one or more surfaces on which a magnetic top can be kept spinning by magnetic induction and from whose surfaces the top maybe thrown and caught in a skillful manner.

Another objective of the invention is to provide a multitude of surfaces in close proximity to a single induction coil, on which the top may spin: wherein power from the coil keeps the top spinning.

Another objective is to provide a sound when the top spins near a coil.

Another objective is to provide a musical tune when a top is spun near a coil.

Still another objective is to make a musical instrument which generates a different musical note for each surface the top spins on.

Also another objective is to activate a different electrical circuit for each surface the top spins on.

FIG. 1 is a front view of a novelty magnetic toy comprising a magnetic top and an induction turret.

FIG. 2 is a schematic diagram of a means to turn on an electrical circuit or musical generator.

FIG. 3 is a schematic diagram of a sensing means to sense the rotation of the top and also to generate musical notes.

FIG. 4 shows a plan view of an induction turret having a multitude of induction coils.

FIG. 5 is a schematic diagram of the induction head of FIG. 4, showing one induction coil and its associated circuitry which senses top rotation and produces a musical note.

FIG. 1 shows an induction turret 1 having a head 2 and a multitude of concave surfaces 3 Inside turret 1 is an induction coil 4 having an iron core 6. Coil 4 is located in close proximity to concave surfaces 3 Also located inside turret 1 are NPN transistors 5 and 8, a 1 megohm current limiting resistor 7, a piezo electric sounder 9 and a battery 10. A handle 11 is attached to head 2.

Also shown is a top 12 comprising a disc magnet 13, with poles as shown, a spindle 14 and a pivot 15.

Transistor 5, coil 4 and top 12 form an electric motor powered by a battery 10, in which coil 4 is the stator and top 12 is the rotor. When top 12 is spun on anyone of the surfaces 3, which must be held horizontal, its rotating magnetic field induces a voltage in coil 4, which turns on transistor 5. This alternately switches battery 10 across coil 4, producing a magnetic field which accelerates top 12. Push pull arrangements are possible, they would more efficiently activate the coil.

By holding handle 11 the top 12 can be thrown from one concave surface 3 and caught on another concave surface 3. The magnetic field produced by coil 4 will power top 12 almost anywhere in a sphere in close proximity to coil 4; therefore a multitude of surfaces maybe located around coil 4. The top does not tend to be powered when its axis of rotation is directly in line with core 6. Resistor 7, transistor 8 and sounder 9 produce a sound which emulates the speed of rotation of top 12. Transistor 8 switches on in synchronism with transistor 5, both of which are driven by coil 4. Sounder 9 produces a beep every time transistor 8 is switched on. This occurs at the rate of rotation of top 12.

FIG. 2 shows a 47000 ohm current limiting resistor 20 in series with a diode 21. Diode 21 is connected to a 1 megohm resistor 22, a 1 mfd capacitor 23 and an NPN transistor 24. Relay 25's coil is connected in series with the collector of transistor 24. Its contacts are connected to switch on a device 26. Device 26 can be an electronic music generator, a light, logic circuitry to play games, etc.

Points A B and C of FIG. 2 are connected to points A B and C of FIG. 1. Items 7, 8 and 9 of FIG. 1 are deleted.

When top 12 spins a voltage is generated in coil 4 which is rectified by diode 21 charging capacitor 23, turning on transistor 24 which activates relay 25. Relay 25 turns on device 26.

FIG. 3 shows a sensing coil 31 connected to a 10 mfd capacitor 30, a 330000 ohm bias resistor 32 and the base of NPN transistor 33. The collector of transistor 33 is connected to a 33000 ohm resistor 34 and a 0.1 mfd capacitor 35. Capacitor 35 is connected to diodes 36 and 37. Diode 37 is connected to a 1 megohm resistor 38, a 1 mfd capacitor 39 and to the base of PNP transistor 40 The collector of transistor 40 is connected to a 25000 ohm variable resistor 41.

The circuit comprising items 30 to 41 is repeated as many times as musical notes that are required. They all connect their variable resistor 41 to point x at the junction of unijunction transistor 43 and the 0.01 mfd capacitor 42.

Transistor 43 is connected to 100 ohm resistors 44 and 45. The base of transistor 47 is connected to the junction of resistor 45 and transistor 43. The collector of transistor 43 is connected to a 1000 ohm resistor 46 and transducer 48. A battery 49 is used to power transistors 33, 40, 43 and 47.

A sensing coil 31 is placed close to each concave surface 3 of FIG. 1. When top 12 rotates close to a coil 31 it induces an alternating voltage in it, which is amplified by transistor 33 and is rectified by rectifiers 36 and 37, charging capacitor 39. This will turn on transistor 40 connecting resistor 41 to the +battery connection. This will cause transistor 43 to oscillate at a frequency dependent upon the resistance of resistor 41 and the capacitance of capacitor 42. Transistor 47 amplifiers this tone which is heard in transducer 48.

Since for each surface 3 items 30 to 41 are repeated, a different tone maybe generated dependent upon the setting of resistor 41. These tones maybe adjusted to provide a musical scale. A tune maybe played by throwing the top from one surface 3 and catching it on another appropriate surface 3.

FIG. 4 shows a head 50 of an induction turret having a multitude of concave surfaces 51 and a multitude of induction coils 52. A handle 53 is connected to head 50.

FIG. 5 shows a coil 52 , having an iron core 54 connected to an NPN transistor 55 The junction of coil 52 and the base of transistor 55 is connected to a 47000 ohm current limiting resistor 56 and diode 57. Diode 57 is connected to the parallel combination of 1 megohm resistor 59, 1 mfd capacitor 60 and the base of transistor 61. The collector of transistor 61 is connected to a piezo electric tone generator 58. A battery 62 is connected to transistors 55 and 61. This is repeated as many times as there are induction coils.

The functions of items 54 and 55 are the same as items 4 and 5 of FIG. 1. Voltages induced in coil 52 by the spinning of top 12 in close proximity to it are rectified by diode 57 and charge capacitor 60 , thereby sensing the rotation of the top. This turns on transistor 61, activating tone generator 58. Each tone generator 58 is tuned to a different frequency and can therefore be used to provide a variety of musical notes. A tune can be played by throwing the spinning top 12 from one surface 51 to another appropriate surface 51.

It is to be understood that the form of the invention herein shown and described is to be taken as the preferred example of the same and that various changes in shape size and arrangement of parts maybe resorted to without departing from the spirit of the invention or the scope of the subjoined claims.

I claim:

1. A novelty magnetic toy having a stator coil and an electric circuit, a magnetic top, supporting means for the top in close proximity to and externally of the coil for supporting the top for rotation relative to and external of the coil, a source of electric potential in the electric circuit and means in the electric circuit operable by the coil current induced by rotation of the magnetic top for momentarily connecting the source of electric potential across the coil to momentarily impose a magnetic field on the magnetic top to accelerate rotation thereof, the supporting means mounted externally on a head which contains the coil, a shank connected to the head, wherein the shank is arranged to form a handle.

2. A novelty magnetic toy having a stator coil and an electric circuit, a magnetic top, a multitude of supporting means for supporting the top in close proximity to and external of the coil for rotation relative to and external of the coil, a source of electric potential in the electric circuit and means in the electric circuit operable by coil current induced by rotation of the magnetic top for momentarily connecting the source of electric potential across the coil to momentarily impose a magnetic field on the magnetic top to accelerate rotation thereof, the supporting means mounted externally on a head which contains the coil, a shank connected to the head, wherein the shank is arranged to form a handle.

3. The novelty magnetic toy of claim 1 comprising an electrically operated sounder, and means to switch the sounder on activated by means sensing the rotation of the top.

4. The novelty magnetic toy of claim 2 comprising an electrically operated sounder, and means to switch on the sounder activated by means sensing the rotation of the top.

5. The novelty magnetic toy of claim 2 comprising a sensing means placed in close proximity to each supporting means, generator means for generating a multitude of musical notes, said sensing means connected to the generator means and arranged to turn on said generator means to generate a specific musical note.

6. A novelty magnetic toy of claim 1 comprising a music generator arranged to be switched on by means sensing the rotation of the top.

7. The novelty magnetic toy of claim 2 comprising sensing means placed in close proximity to each supporting means and means to switch on an electrical circuit activated by said sensing means.

8. The novelty magnetic toy of claim 1 comprising a multitude of supporting surfaces and an induction coil placed in close proximity to each surface, a generator means for generating a multitude of musical notes, each surface having a sensing means for sensing the rotation of the top and each sensing means connected to the generator and arranged to turn on said generator to generate a specific musical note.

9. The novelty magnetic toy of claim 1 comprising a multitude of supporting surfaces and an induction coil placed in close proximity to each surface, sensing means placed in close proximity to each supporting surface and means to switch on an electrical circuit activated by said sensing means.

* * * * *